United States Patent [19]

Selack et al.

[11] Patent Number: 4,834,242

[45] Date of Patent: May 30, 1989

[54] SHIPPING, STORAGE AND HANDLING ARRANGEMENT FOR SHEET AND CONTINUOUS BUSINESS FORMS

[75] Inventors: Donald A. Selack, York, Pa.; Robert J. Smith; Roland R. Weeks, both of Dayton, Ohio

[73] Assignee: The Standard Register Company, Dayton, Ohio

[21] Appl. No.: 153,991

[22] Filed: Feb. 9, 1988

[51] Int. Cl.[4] ..... B65D 1/34; B65D 6/04

[52] U.S. Cl. ..... 206/555; 206/451; 206/597

[58] Field of Search ..... 206/494, 554, 555, 45.28, 206/597

[56] References Cited

U.S. PATENT DOCUMENTS

| | | | |
|---|---|---|---|
| 1,588,121 | 6/1926 | Markert | 206/451 |
| 1,658,085 | 2/1928 | Hudson | 206/554 |
| 1,756,115 | 4/1930 | Daly | 206/451 |
| 1,983,868 | 12/1934 | Morrisroe | 206/451 |
| 3,765,044 | 10/1973 | Hanahan et al. | 206/555 |
| 4,365,709 | 12/1982 | Lester | 206/494 |
| 4,366,916 | 1/1983 | Guido et al. | 206/554 |
| 4,405,044 | 9/1983 | Flower et al. | 206/45.31 |
| 4,417,655 | 11/1983 | Forbes, Jr. | 206/45.28 |
| 4,458,814 | 7/1984 | Meschi | 206/494 |
| 4,623,074 | 11/1986 | Dearwester | 206/494 |

FOREIGN PATENT DOCUMENTS

| | | | |
|---|---|---|---|
| 2019362 | 10/1979 | United Kingdom | 206/555 |

*Primary Examiner*—Joseph Man-Fu Moy

*Attorney, Agent, or Firm*—Killworth, Gottman, Hagan & Schaeff

[57] ABSTRACT

A shippable quantity of sheet products includes a shipping pallet, a bottom cap member, positioned on the pallet, and a plurality of supplies of the sheet products stacked in one or more layers on the bottom cap member. Each of the plurality of supplies of the sheet products including a stack of the sheet products, a stack cover, having a top and four sides, with the stack cover positioned on top of the stack of sheet products, and a stack tray, having a bottom and four sides. The stack tray, receiving the stack of sheet products, has a pair of generally vertical perforation lines on each of two opposing ones of its four sides. Each pair of the generally vertical perforation lines defines an access tab therebetween which may be at least partially separated from the side of the tray by tearing along the perforation lines. This exposes the side of the stack of sheet products in the tray. A shim in the bottom of the tray supports the stack of sheet products. A top cap member is positioned on the top layer of the plurality of supplies of the sheet products. A web of substantially moisture impermeable material covers the cap members, the shipping pallet, and the supplies of sheet products to reduce the absorption of moisture by the sheet products.

20 Claims, 3 Drawing Sheets

SHIPPING, STORAGE AND HANDLING ARRANGEMENT FOR SHEET AND CONTINUOUS BUSINESS FORMS

BACKGROUND OF THE INVENTION

The present invention relates to a shipping arrangement including an improved carton for sheet products and, more particularly, to such an arrangement in which a stack of sheet products is well protected during shipping and may be easily removed from the carton prior to use.

Laser printers have come into increasing use for various printing applications. Such printers are especially well suited to tasks requiring high speed printing of variable information, such as for example printing monthly billing statements and the like, under computer control. While laser printers are extremely fast and reliable, their successful operation depends upon the use of cut sheet or continuous paper stock having a moisture content within rather precisely defined limits.

Paper which is originally produced with the desired moisture content may subsequently absorb additional moisture from its environment during shipping or storage if it is not properly protected. As a consequence, it has become common to wrap stacks of the paper in a polyethylene film, thus providing a moisture barrier. The problem with this arrangement is that the film is difficult to tear or cut, and removing it from a stack of paper sheets is undesirably time consuming. Additionally, a high speed laser printer may typically have a sheet supply hopper capable of holding 2000 sheets, while film wrapped stacks of paper have usually contained only 500 sheets. As a result, the printer operator may be required to open four film wrapped stacks of paper sheets each time the sheet supply hopper is to be refilled.

Yet another difficulty encountered with some laser printer sheet supply arrangements is the inability to feed the bottom sheets in the supply hopper. The sheet supply may not be capable of feeding the bottom one inch of sheets in a stack, for example. It will be appreciated that this results in more frequent refilling of the sheet supply hopper than would otherwise be necessary.

It is seen, therefore, that there is a need for a simple shipping arrangement including an improved carton for a stack of sheet products which provides adequate protection for the products and which permits easy removal of the stack.

SUMMARY OF THE INVENTION

A carton according to the present invention which meets this need provides packing for a stack of sheet products. The carton includes a stack cover, having a top and four sides, which is sized so as to permit it to be placed over a stack of sheet products, and a stack tray. The stack tray has a bottom and four sides and is sized to receive a stack of sheet products therein. The stack tray has a pair of generally vertical perforation lines on each of two of the four sides. Each pair of the vertical perforation lines defines an access tab therebetween which may be separated from the side of the tray by tearing along the perforation lines so as to expose the side of the stack of sheet products in the tray. This provides access to the bottom of the stack of sheet products and facilitates removal of the stack from the tray.

The stack tray preferably defines the pairs of vertical perforation lines on opposing sides of the tray. The pairs of vertical perforation lines extend from the top to the bottom of the opposing sides of the stack tray.

A shim is received in the stack tray on the bottom thereof beneath the stack of sheet products. The shim defines a pair of recesses on opposite sides thereof to facilitate manual engagement of the bottom of the shim, whereby the stack of sheet products may be easily removed from the tray. The recesses are positioned such that each recess aligns with a respective one of the tabs when the shim is placed in the stack tray. The shim preferably comprises two layers of sheet material, the bottom of the two layers including a pair of notches in opposing edges thereof so as to define the pair of recesses.

The stack cover and the stack tray may be made of cardboard. The stack cover and the stack tray are sized such that the stack cover is received within the stack tray when the cover is placed over a stack resting in the tray.

The bottom of the stack tray may further define a pair of cuts, each bridging an associated pair of perforation lines, whereby tearing along the perforation lines results in complete separation of the access tabs from the sides and notches in the bottom of the tray to facilitate manual removal of the stack of sheet products therefrom. The cuts are configured to produce trapezoidal notches in the bottom of the tray.

A supply of sheet products, includes:

(a) a stack of the sheet products, a stack cover, having a top and four sides, the stack cover positioned on top of the stack of sheet products;

(b) a stack tray, having a bottom and four sides, the stack tray receiving the stack of sheet products therein, the stack tray having a pair of generally vertical perforation lines on each of two opposing ones of the four sides, each pair of the generally vertical perforation lines defining an access tab therebetween which may be at least partially separated from the side of the tray by tearing along the perforation lines so as to expose the side of the stack of sheet products in the tray; and (c) a shim in the bottom of the tray supporting the stack of sheet products.

A shippable quantity of sheet products includes a shipping pallet, and a bottom cap member, positioned on the pallet. A plurality of the supplies of the sheet products, described above, are stacked in one or more layers on the bottom cap member. A top cap member is positioned on top of the top layer of the plurality of supplies of the sheet products. A web of substantially moisture impermeable material covering the cap members, shipping pallet, and supplies of sheet products to reduce the absorption of moisture by the sheet products. The sheet products may be cut sheet products. Alternatively, the sheet products may be continuous feed sheet products.

Accordingly, it is an object of the present invention to provide a carton for packing a stack of sheet products in which the removal of the sheet products from the carton is facilitated; to provide a supply of continuous or cut sheet products in such a carton; and to provide a shippable quantity of sheet products including a plurality of such supplies.

Other objects and advantages of the invention will be apparent from the following description, the accompanying drawings and the appended claims.

DETAILED DESCRIPTION OF THE PREFERRED EMBODIMENTS

Figure 2:
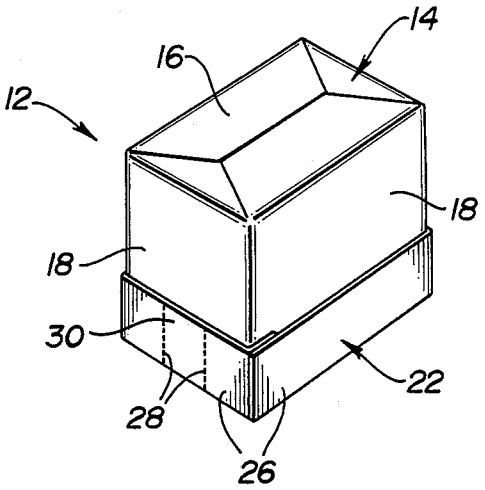
FIG. 2 is a perspective view of a first embodiment of a carton for packing a stack of sheet products which may be utilized in the shippable quantity of sheet products of FIG. 1.
Figure 3:
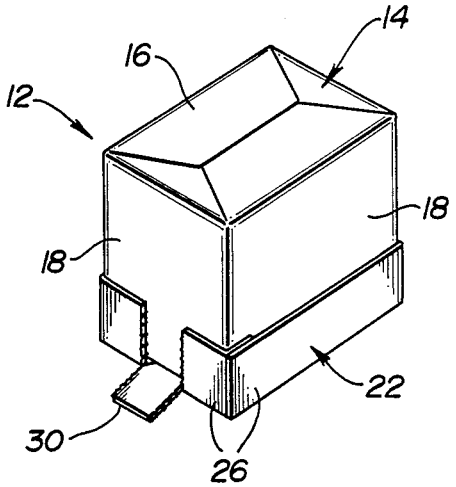
FIG. 3 is a perspective view, similar to FIG. 2, showing an access tab of the stack tray separated from the side of the tray along vertical perforation lines.
Figure 4:
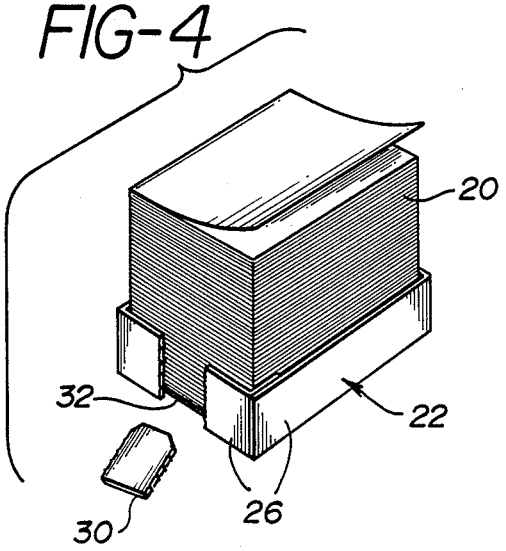
FIG. 4 is a perspective view, similar to FIG. 3, showing the access tab of the stack tray and the stack cover removed.
Figure 5:
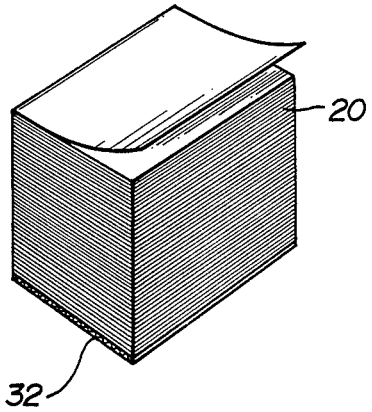
FIG. 5 is a perspective view, similar to FIG. 4, showing the stack of sheet products removed from the stack tray.
Figure 6:
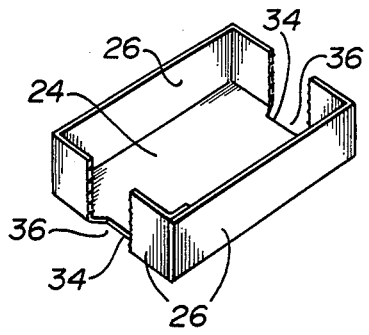
FIG. 6 is a perspective view of the stack tray of FIGS. 2–5 with the sheet products removed.
Figure 7:
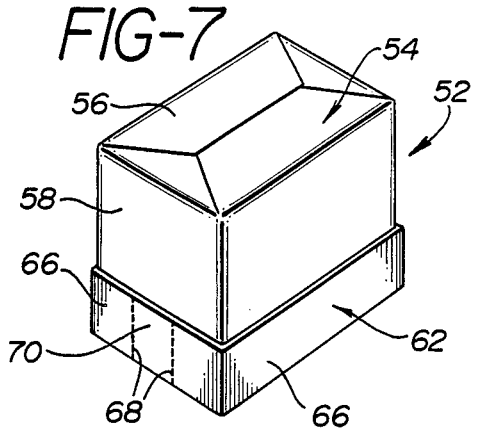
FIG. 7 is a perspective view of a second embodiment of a carton for packing a stack of sheet products which may be utilized in the shippable quantity of sheet products of FIG. 1.

Reference is made to FIG. 1 and FIGS. 2–6 which depict a shippable quantity of sheet products 10 and a first embodiment of a carton 12 for packing a stack of sheet products, respectively. Although cut sheet products are shown in FIGS. 4 and 5, it will be appreciated that the present invention is equally useful in conjunction with stacks of continuous feed sheets, such as for example continuous feed forms. A plurality of filled cartons 12 are incorporated into the shippable quantity of sheet products 10, as is discussed more fully below.

Each of the cartons 12 includes a stack cover 14, having a top 16 and four sides 18. The stack cover 14 is sized so as to permit it to be placed over a stack of sheet products 20 (FIGS. 4 and 5). Each of the cartons 12 further includes a stack tray 22, having a bottom 24 (FIG. 6) and four sides 26. The stack tray 22 is sized to permit it to receive a stack of sheet products 20 therein. The stack cover 14 is also received within the stack tray 22 when the cover is placed over the stack. The stack cover 14 and the stack tray 22 are preferably made of cardboard.

The stack tray 22 has a pair of generally vertical perforation lines 28 on each of two of the four sides 26. The perforation lines are positioned on opposing sides of the stack tray 22 and extend from the top to the bottom of those sides. Each pair of the vertical perforation lines 28 defines an access tab 30 therebetween which may be separated from the side 26 of the tray 22 by tearing along the perforation lines 28, as shown in FIG. 3. When the cover 14 is removed, as shown in FIG. 4, the side of the stack of sheet products 20 is exposed, providing access to the bottom of the stack and facilitating its removal from the tray 22. Toward this end, a shim 32, positioned in the bottom of the tray 22, supports the stack 20 and allows it to be lifted easily from the tray.

In order to provide for the complete removal of an access tab 30 from the stack tray 22, the bottom 24 of the tray 22 further defines a pair of cuts 34, each bridging an associated pair of the perforation lines 28. The cuts 34 are configured to produce trapezoidal notches 36 in the bottom of the tray 22 when the access tabs 30 are removed from the tray. The notches 36 permit a printer operator to lift the shim 32 and the stack 20 easily from the tray.

Figure 1:
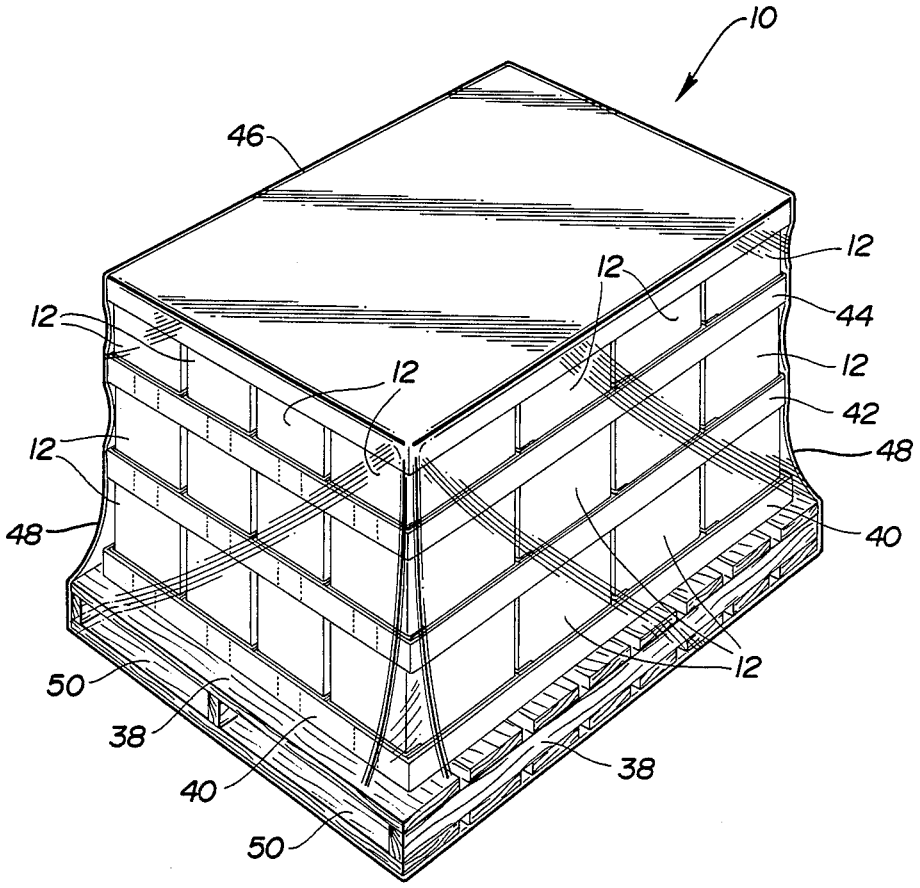
FIG. 1 is a perspective view of a shippable quantity of sheet products, assembled according to the present invention.

A plurality of supplies of the sheet products, each constituting a carton as shown in FIGS. 2 and 3 filled with a stack of the sheet products, may be assembled as shown in FIG. 1 as a shippable quantity of sheet products. Shippable quantity 10 includes a shipping pallet 38, and a bottom cap member 40, positioned on the pallet 38. The supplies of the sheet products in cartons 12 are stacked in one or more layers on the bottom cap member 40. If desired, one or more additional bottom cap members 42 and 44 may be provided between each of the layers of cartons 12.

Each of the cap members 40, 42, and 44 is preferably made of cardboard. The cap members provide for enhanced stability of the quantity of sheet products 10, reducing the likelihood of damage to the sheet products during shipment. Also provided for this purpose is a top cap member 46, positioned on the top of the top layer of the plurality of supplies of the sheet products. The top cap member 46, preferably made of cardboard, and the bottom cap members 40, 42, and 44 may be treated so as to make them less likely to absorb moisture and transmit it to the sheet products in the cartons 12.

A web 48 of substantially moisture impermeable material covers the cap members 40, 42, 44, and 46 shipping pallet 38, and the supplies of sheet products in cartons 12 to reduce the absorption of moisture by the sheet products. Web 48 may preferably comprise a web of polyethylene film which is stretch wrapped around the stacks of cartons and the caps and pallets. The pallet 38 is typically lifted by inserting the forks of a fork lift truck into the openings 50 in the pallet. Although this results in the web 48 being pierced, it has been found that the resulting holes in the web 48 do not allow sufficient moisture to reach the sheets in boxes 12 so as to adversely affect their usefulness in conjunction with laser printers.

The boxes 12 will remain covered as shown in FIG. 1 throughout shipping and storage of the shippable quantity of sheet products 10 of FIG. 1. When the sheet products are to be used, the polyethylene film 48 is removed, and a carton 12 removed from pallet 38. The tabs 30 of the stack tray 22 are then separated from the sides of the tray, as shown in FIGS. 3 and 4, and the cover 14 is removed. The printer operator then grasps the shim 32 in the area exposed by notches 36 and raises the stack 20 and the shim 32, removing them from the tray The stack 20 and shim 32 may then be placed in the sheet supply hopper of a laser printer. By this technique, the hopper may be filled to capacity without the need to open a number of packages. Additionally, by placing the shim in the sheet supply hopper of the printer with the stack 20, the shim insures that the bottom sheets of the stack do not go unused.

Reference is now made to FIGS. 7–11 of the drawings which illustrate a second embodiment of a carton, indicated at 52, constructed according to the present invention. A plurality of cartons 52 may be incorporated in the shippable quantity of sheet products shown in FIG. 1 in place of the cartons 12, if desired.

Figure 9:
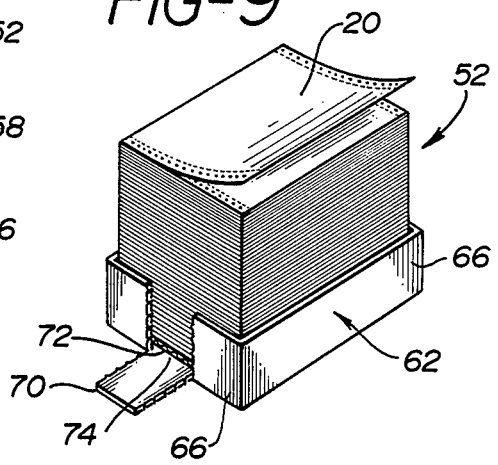
FIG. 9 is a perspective view, similar to FIG. 8, showing the access tab of the stack tray and the stack cover removed.
Figure 10:
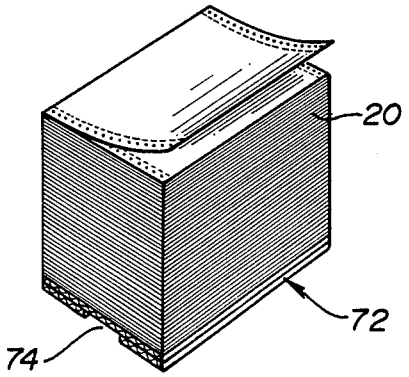
FIG. 10 is a perspective view, similar to FIG. 9, showing the stack of sheet products removed from the stack tray.

Carton 52 includes a stack cover 54, having a top 56 and four sides 58. The stack cover 54 is sized so as to permit it to be placed over a stack of sheet products 20 (FIGS. 9 and 10). Carton 52 further includes a stack tray 62, having a bottom (not shown) and four sides 66. The stack tray 62 is sized to permit it to receive a stack of sheet products 20 therein. The stack cover 54 is also received within the stack tray 62 when the cover is placed over the stack. The stack cover 54 and the stack tray 22, like the corresponding parts of the first embodiment, are preferably made of cardboard.

Figure 8:
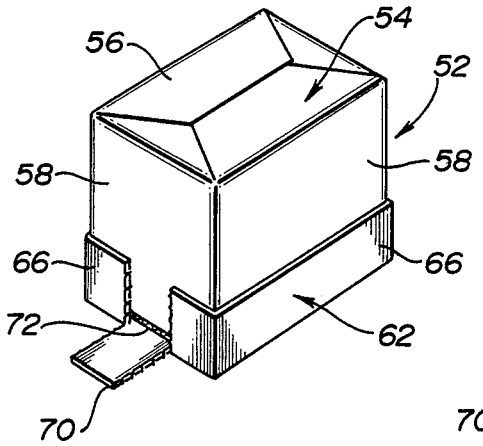
FIG. 8 is a perspective view, similar to FIG. 7, showing an access tab of the stack tray separated from the side of the tray along vertical perforation lines.

The stack tray 52 has a pair of generally vertical perforation lines 68 on each of two of the four sides 66. The perforation lines are positioned on opposing sides of the stack tray 62, and extend from the top to the bottom of those sides. Each pair of the vertical perforation lines 68 defines an access tab 30 therebetween which may be separated from the side 66 of the tray 62 by tearing along the perforation lines 68, as shown in FIGS. 8 and 9. Note that the access tab 70 remains attached to the tray 62 along its bottom edge.

When the cover 54 is removed, as shown in FIG. 9, the side of the stack of sheet products 20 is exposed, providing access to the bottom of the stack and facilitating its removal from the tray 62. Toward this end, a shim 72, positioned in the bottom of the tray 62 as shown in FIG. 9, supports the stack 20 and allows it to be lifted easily from the tray.

Figure 11:
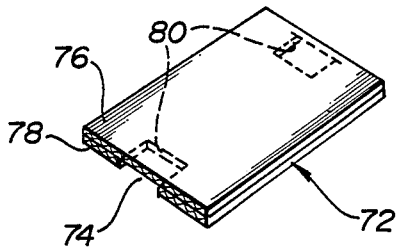
FIG. 11 is a perspective view of the shim of FIGS. 7–10 with the sheet products removed.

The shim 72 defines a pair of recesses 74 on opposite sides of the shim to facilitate manual engagement of the bottom of the shim 72. A printer operator can insert his fingers into the recesses 74 and easily lift the shim 72 and the stack of sheet products 20 from the tray 62. The recesses 74 are positioned as shown in FIGS. 9, 10 and 11 such that each such recess aligns with a respective one of the tabs 70 when the shim is placed in the stack tray. The shim 72 comprises two layers 76 and 78 of sheet material, which is preferably cardboard. The bottom layer 78 of the two layers includes a pair of notches 80 in opposing edges thereof so as to define the pair of recesses 74. The embodiment of FIGS. 7-11 has the advantage over the first embodiment that the bottom of the tray 62 does not have any cuts extending therethrough. This embodiment does, however, incorporate a two layer shim which adds to the cost of the carton.

Having described the invention in detail and by reference to the preferred embodiment thereof, it will be apparent that other modifications and variations are possible without departing from the scope of the invention defined in the appended claims.

What is claimed is:

1. A carton for packing a stack of sheet products, comprising:

a stack cover, having a top and four sides, said stack cover sized so as to permit it to be placed over a stack of sheet products, a stack tray, having a bottom and four sides, said stack tray sized so as to permit it to receive a stack of sheet products therein, said stack tray having a pair of generally vertical perforation lines on each of two of said four sides, each pair of said vertical perforation lines defining an access tab therebetween which may be separated from the side of the tray by tearing along said perforation lines so as to expose the side of the stack of sheet products in said tray, and a shim received in said stack tray on the bottom thereof beneath said stack of sheet products, said shim defining a pair of recesses on opposite sides of the shim to facilitate manual engagement of the bottom of the shim, whereby the stack of sheet products may be easily removed from the tray.

2. The carton of claim 1 in which said stack tray defines said pairs of vertical perforation lines on opposing sides of said stack tray.

3. The carton of claim 2 in which said pairs of vertical perforation lines extend from the top to the bottom of said opposing sides of said stack tray.

4. The carton of claim 1 in which said recesses are positioned such that each recess aligns with a respective one of the tabs when the shim is placed in the stack tray.

5. The carton of claim 1 in which said shim comprises two layers of sheet material, the bottom of the two layers including a pair of notches in opposing edges thereof so as to define said pair of recesses.

6. The carton of claim 1 in which said stack cover and said stack tray are made of cardboard.

7. The carton of claim 1 in which said stack cover and said stack tray are sized such that said stack cover is received within said stack tray when said cover is placed over a stack resting in said tray.

8. The carton of claim 1 in which the bottom of said stack tray further defines a pair of cuts, each bridging an associated pair of perforation lines, whereby tearing along said perforation lines results in complete separation of said access tabs from said sides and notches in the bottom of said tray to facilitate manual removal of said stack of sheet products therefrom.

9. The carton of claim 8 in which said cuts are configured to produce trapezoidal notches in the bottom of the tray.

10. A supply of sheet products, comprising:

a stack of said sheet products, a stack cover, having a top and four sides, said stack cover positioned on top of said track of sheet products, a stack tray, having a bottom and four sides, said stack tray receiving said stack of sheet products therein, said stack tray having a pair of generally vertical perforation lines on each of two opposing ones of said four sides, each pair of said generally vertical perforation lines defining an access tab therebetween which may be at least partially separated form the side of the tray by tearing along said perforation lines so as to expose the side of said stack of sheet products in said tray, and a shim in bottom of said tray supporting said stack of sheet products, said shim defining a pair of recesses on opposite sides of the shim to facilitate manual engagement of the bottom of the shim, whereby the stack of sheet products may be easily removed from the tray.

11. The supply of sheet products of claim 10 in which said pairs of vertical perforation lines extend from the top to the bottom of said opposing sides of said stack tray.

12. The supply of sheet products of claim 10 in which said recesses are positioned such that each recess align with a respective one of the tabs when the shim is placed in the stack tray.

13. The supply of sheet products of claim 10 in which said shim comprises two layers of sheet material, the bottom of the two layers including a pair of notches in opposing edges thereof so as to define said pair of recesses.

14. The supply of sheet products of claim 10 in which the bottom of said stack tray further defines a pair of cuts, each bridging an associated pair of perforation line, whereby tearing along said perforation lines results in complete separation of said access tabs from said sides and notches in the bottom of said tray to facilitate manual removal of said stack of sheet products therefrom.

15. The supply of sheet products of claim 14 in which said cuts are configured to produce trapezoidal notches in the bottom of the tray.

16. The supply of sheet products of claim 10 in which said stack of said sheet products comprises a stack of continuous sheet products.

17. The supply of sheet products of claim 10 in which said stack of said sheet products comprises a stack of cut sheet products.

18. A shippable quantity of sheet products comprising:

a shipping pallet, a bottom cap member, positioned on said pallet, a plurality of supplies of said sheet products stacked in one or more layers on said bottom cap member, each of said plurality of supplies of said sheet products including a stack of said sheet products, a stack cover, having a top and four sides, said stack cover positioned on top of said stack of sheet products, a stack tray, having a bottom and four sides, said stack tray receiving said stack of sheet products therein, said stack tray having a pair of generally vertical perforation lines on each of two opposing ones of said four sides, each pair of said generally vertical perforation lines defining an access tab therebetween which may be at least partially separated from the side of the tray by tearing along said perforation lines so as to expose the side of said stack of sheet products in said tray, and a shim in said bottom of said tray supporting said stack of sheet products, a top cap member, positioned on the top of said top layer of said plurality of supplies of said sheet products, and a web of substantially moisture impermeable material covering said cap members, shipping pallet, and supplies of sheet products to reduce the absorption of moisture by said sheet products.

19. The shippable quantity of sheet products of claim 18 in which said sheet products are cut sheet products.

20. The shippable quantity of sheet products of claim 18 in which said sheet products are continuous feed sheet products.

* * * * *

UNITED STATES PATENT AND TRADEMARK OFFICE

CERTIFICATE OF CORRECTION

PATENT NO. : 4,834,242

DATED : May 30, 1989

INVENTOR(S) : Donald A. Selack, Robert J. Smith and Roland A Weeks

It is certified that error appears in the above-identified patent and that said Letters Patent is hereby corrected as shown below:

Col. 4, line 62 "tray The" should be --tray. The--.

Col. 6, line 43, claim 10 "track" should be --stack--.

Signed and Sealed this

Fifteenth Day of May, 1990

*Attest:*

HARRY F. MANBECK, JR.

*Attesting Officer*

*Commissioner of Patents and Trademarks*